US005782219A

United States Patent [19]

Frey et al.

[11] Patent Number: 5,782,219

[45] Date of Patent: Jul. 21, 1998

[54] RECIPROCATING ENGINE WITH A WOBBLE PLATE TRANSMISSION

[75] Inventors: Michael Frey, Lindau, Germany; Frank Obrist, Dornbirn, Austria; Peter Kuhn, Weinheim, Germany

[73] Assignees: Audi Aktiengesellschaft, Ingolstadt; Bayerische Motoren Werke Aktiengesellschaft, Munich; Mercedes-Benz Aktiengesellschaft, Stuttgart, all of Germany

[21] Appl. No.: 842,133

[22] Filed: Apr. 23, 1997

[30] Foreign Application Priority Data

Apr. 27, 1996 [DE] Germany ..... 196 16 961.5

[51] Int. Cl.[6] ..... F02B 75/26

[52] U.S. Cl. ..... 123/56.3; 123/56.6

[58] Field of Search ..... 123/56.3, 56.4, 123/56.5, 56.6

[56] References Cited

U.S. PATENT DOCUMENTS

| | | | |
|---|---|---|---|
| 1,869,189 | 7/1932 | Eggert | 123/56.3 |
| 1,968,470 | 7/1934 | Szombathy | 123/56.4 |
| 2,368,933 | 2/1945 | Lindeman | 123/56.6 |
| 2,513,083 | 6/1950 | Eckert | 123/56.6 |
| 2,532,254 | 11/1950 | Bouchard | 123/56.4 |
| 2,551,025 | 5/1951 | Lindeman, Jr. | 123/56.3 |
| 3,319,874 | 5/1967 | Welsh et al. | 123/56.4 |
| 4,886,423 | 12/1989 | Iwanami . | |
| 5,553,582 | 9/1996 | Speas | 123/56.4 |

FOREIGN PATENT DOCUMENTS

| | | |
|---|---|---|
| 062744A1 | 11/1994 | European Pat. Off. . |
| WO92/17705 | 10/1992 | WIPO . |

*Primary Examiner*—David A. Okonsky
*Attorney, Agent, or Firm*—Ladas & Parry

[57] ABSTRACT

The reciprocating engine more particularly intended for high pressure applications or motor vehicle $CO_2$ air conditioning systems, has a wobble plate transmission, whose wobble plate (3) can assume different inclined positions for power control purposes. For this purpose is provided a wobble joint constructed as a knuckle joint, allowing the tilting movement of the wobble plate (3) supported on the engine shaft (4) through a slot guide (11, 11') of a driving pin (9). A good controllability of the reciprocating engine results from friction-reducing engine components provided on the driving pin (9) and comprising bearings (32, 33), which allow a rotation of the driving pin (9) about its longitudinal axis, as well as a sliding bush or a roller bearing (47) on one of the pin ends (40, 43) engaging in slot guides (11, 11'). In addition, in the vicinity of the more strongly loaded pin end is provided an axial force-absorbing sliding disk (42).

5 Claims, 5 Drawing Sheets

RECIPROCATING ENGINE WITH A WOBBLE PLATE TRANSMISSION

Figure 1:
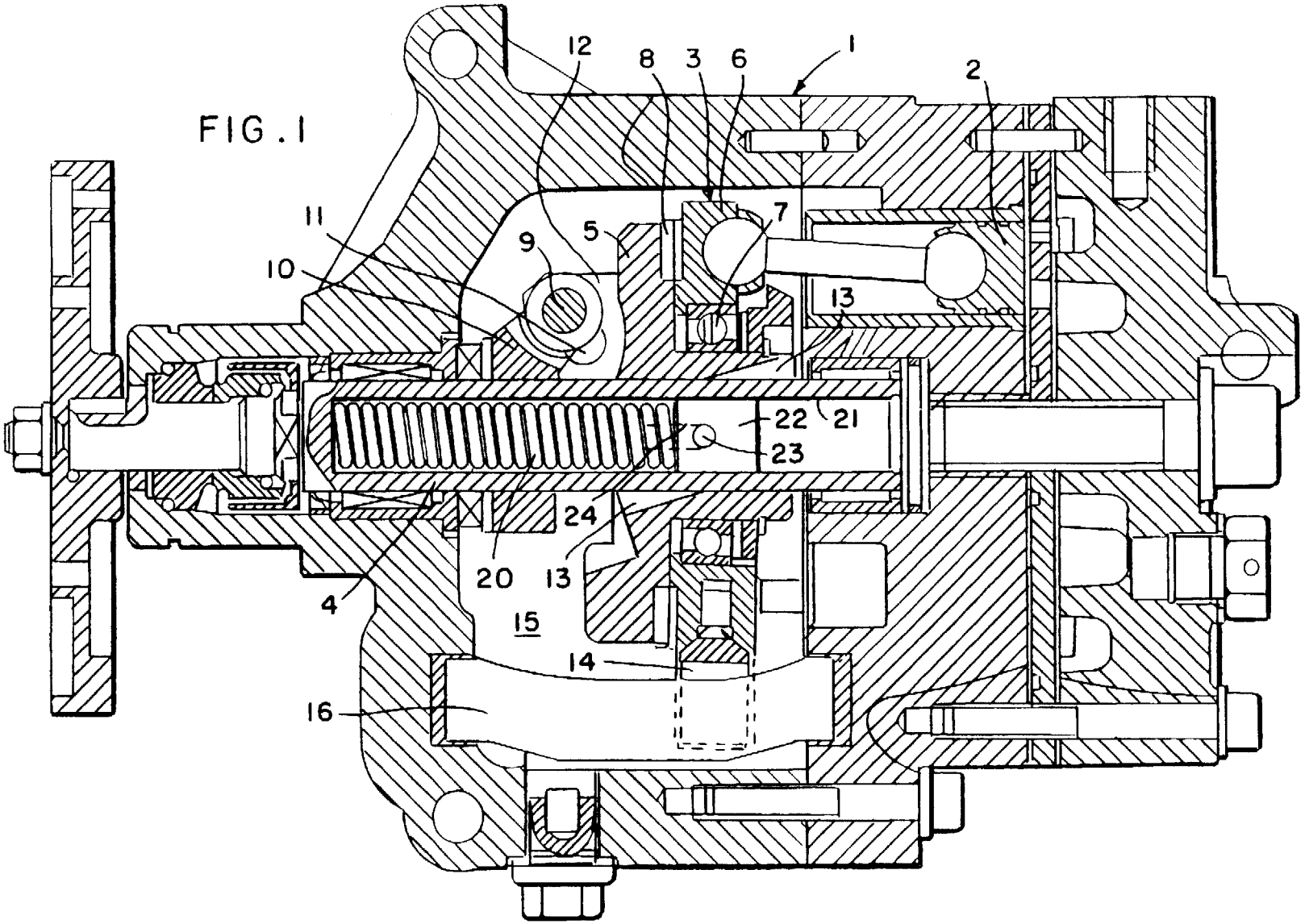

The invention relates to a reciprocating engine with a wobble plate transmission in accordance with the features of the preamble of claim 1.

A reciprocating engine of this type is e.g. known from EP-A-623744. Its wobble joint has a relatively short driving pin, which engages with one end in a guide slot of a driving extension. This pin-slot guide must transmit the entire driving torque of the engine, so that on it considerable transverse forces occur and the movement of the driving pin in the guide slot is opposed by correspondingly high friction forces, which prevent a precise or low-hysteresis control of the mechanical efficiency. In order to reduce the wear caused by the frictional forces, it has been proposed for said engine to envelop the part of the driving pin engaging in the slot guide with a ring having a higher resistance to wear and which slides in the slot guide with an outer face flattened on one side or diametrically on both sides. As a result of the high transverse forces, associated with the sliding guide used, considerable frictional resistances still occur which prevent a precise control of the mechanical efficiency.

U.S. Pat. No. 4,886,423 discloses a reciprocating engine having a tapered washer engaging in the piston body, in which for the adjustability of its inclined position a joint means is provided, which has on the driving shaft or on the tapered washer in the vicinity of the rotation axis a narrow, flat driver, which engages in screwdriver-like manner in a slot space between two bearing walls or cheeks. The two ends of the driving pin, which slide in slot guides, carry, compared with the engine according to EP-A-623744, wear-reducing bushes for the sliding contact with the slot guides. As the torque transmission takes place substantially through the large-area engagement between the lateral faces of the driver and the bearing cheeks, frictional forces disadvantageous to a precise control occur, even if in accordance with U.S. Pat. No. 4,886,423 the frictional force in the central slot guide is reduced by a roller bearing.

It is known from WO 92/17705 (PCT/JP32/00384) to arrange in equiaxially spaced manner two joints in each case having a slot guide and a driving pin, so that corresponding to the spaces the forces for the torque transmission are lower. However, there are no additional engine components for reducing friction between the surfaces rubbing on one another. In accordance with a kinematically differently acting embodiment of WO 92/17705, a slot guide is avoided by using a spherical joint and a driving pin with an axial guide.

The problem of the invention is to find a reciprocating engine of the aforementioned type, which as a result of low frictional resistances and even in the case of a compact high pressure construction can be accurately controlled, so that in satisfactory manner it is suitable for a coupling-free power control of motor vehicle $CO_2$ air conditioning systems.

According to the invention, this problem is solved by the characterizing features of claim 1.

Advantageous embodiments of the invention are described in greater detail hereinafter relative to the attached drawings, wherein show:

FIG. 1 An axial section through an embodiment of a reciprocating engine according to the invention with a minimum stroke setting.

Figure 2:
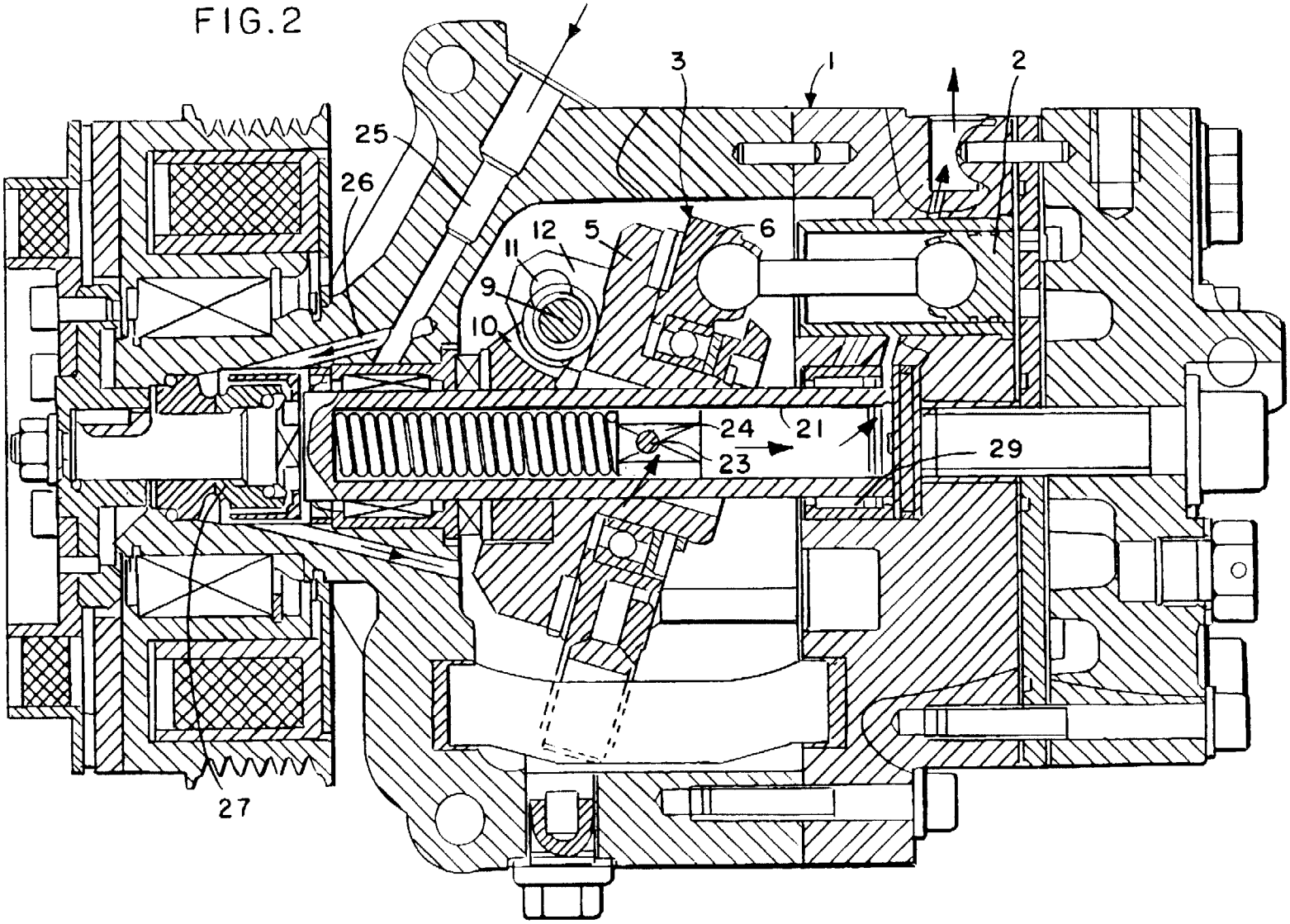

FIG. 2 The reciprocating engine of FIG. 1 with maximum stroke setting.

Figure 3:
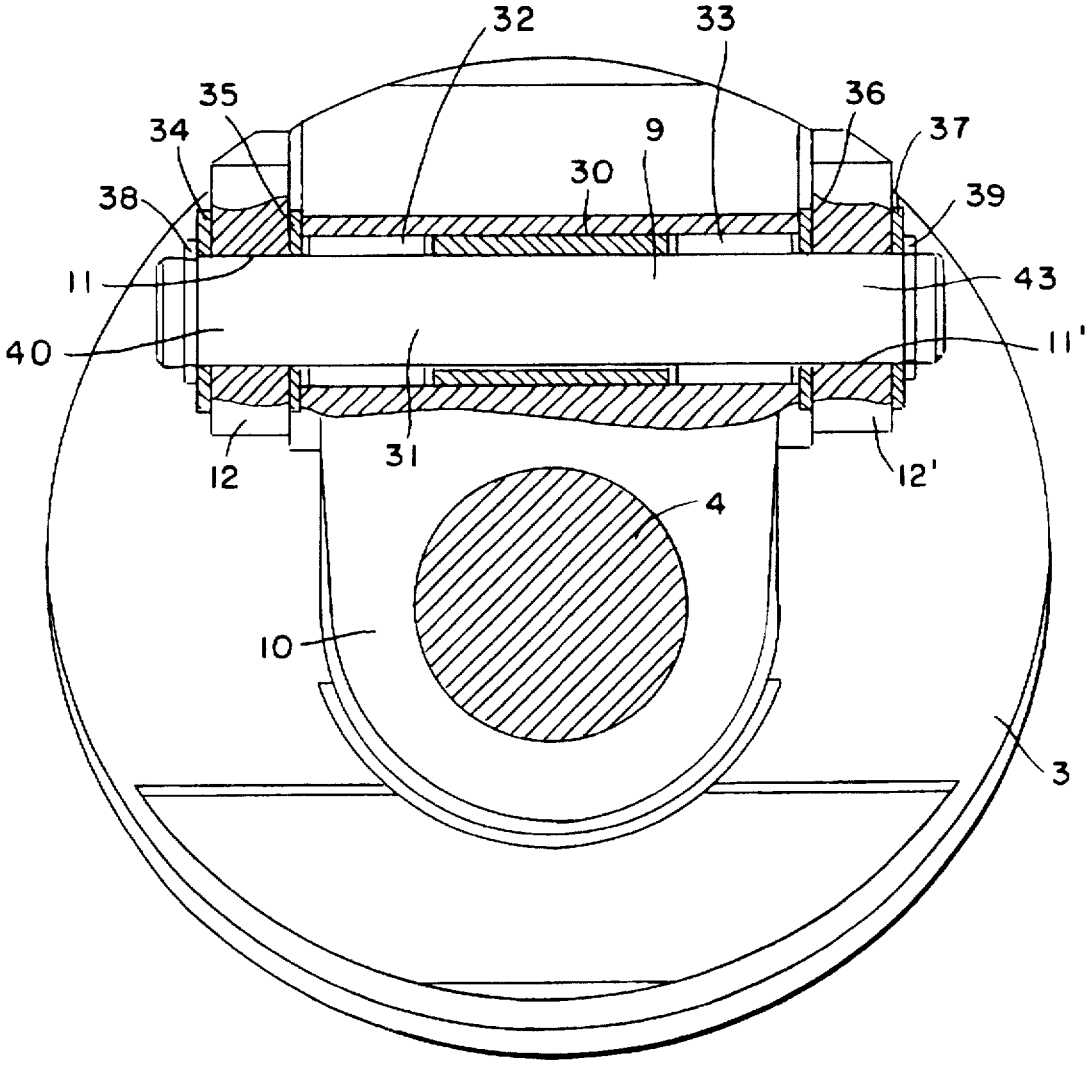
Figure 4:
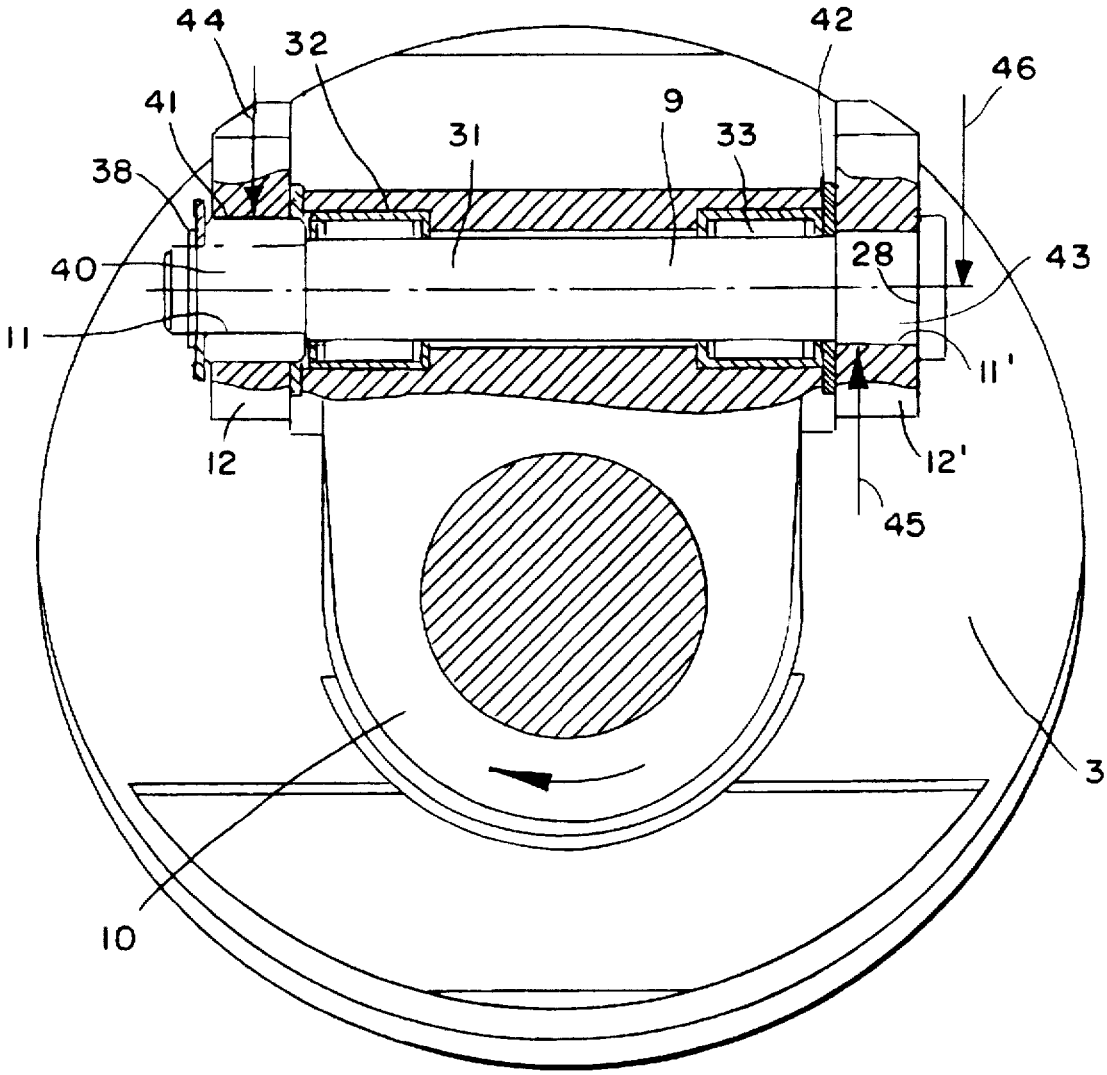
Figure 5:
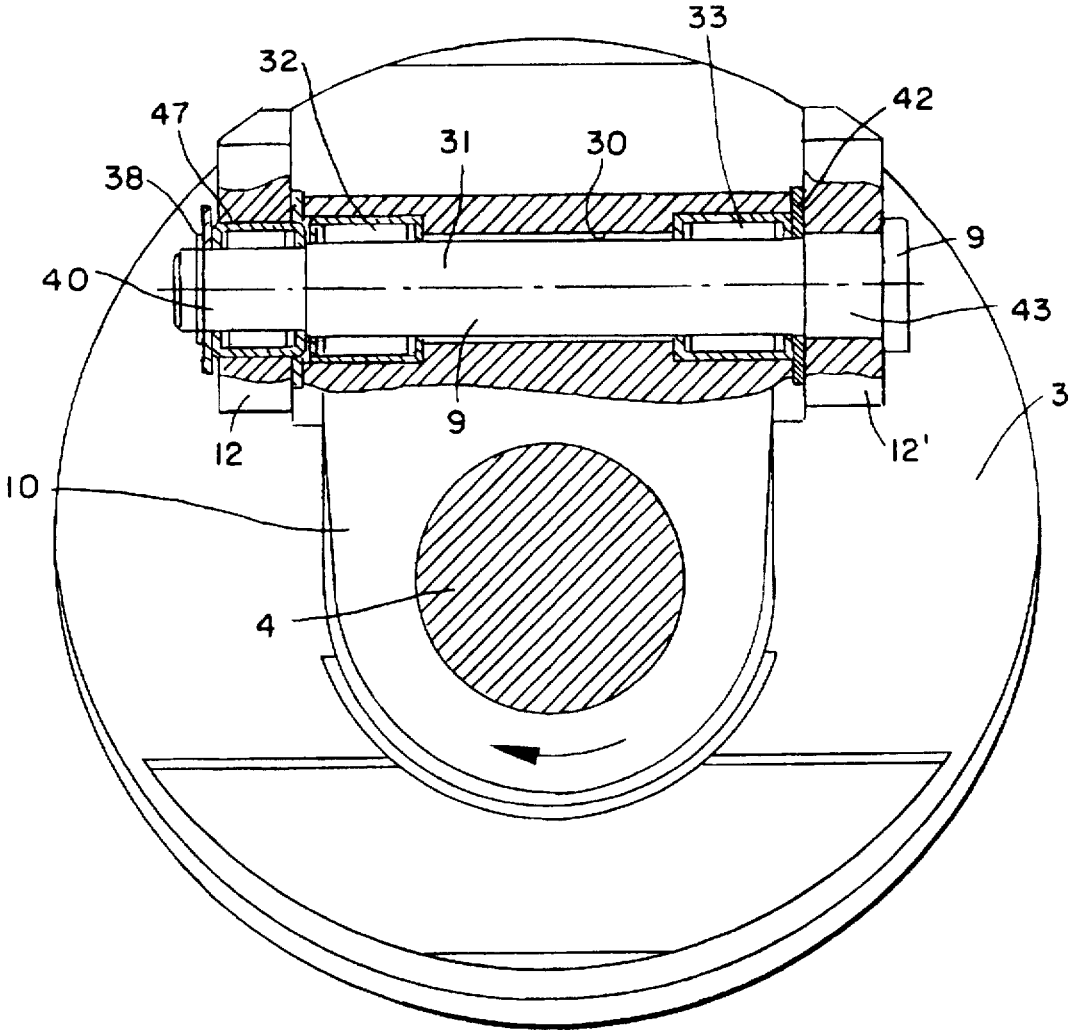

FIGS. 3 to 5 Partial cross-sections in the area of the wobble joint along the axis of the driving pin and radially to the engine shaft, corresponding to three embodiments of the invention.

The fundamental construction and operation of a reciprocating engine of the aforementioned type are adequately known to the expert through extensive patent literature, so that a more detailed description is unnecessary.

The reciprocating engine 1 has e.g. seven pistons 2 driven by the wobbling movement and are juxtaposed in the circumferential direction of the engine. The wobble plate 3 has a first plate part 5 rotating with the engine shaft 4 and a second plate part 6 prevented from rotating and in drive connection with the piston 2. For the transmission of the wobbling movement radially and axially acting roller bearings 7, 8 are provided between the two plate parts 5, 6.

The connection between the engine shaft 4 and the corotating, first plate part 5 allowing the different inclined or tilting positions of the wobble plate 3 takes place through a driving pin 9, located on the end of a driver 10 fixed to the engine shaft 4. The driver engages in in each case one guide slot 11, 11' of driving extensions 12, 12' allowing the tilting movement of the wobble plate 3 on the engine shaft 4 and which are laterally shaped onto the corotating, first plate part 5. The wobble plate 3 is supported on the engine shaft 4 through a central recess 13, which is bilaterally extended in the shaft direction, so that there is adequate free space for the tilting movements performed on the engine shaft 4. Rotation of the plate part 6 is prevented by a web part 16 extending through the drive area 15 and engaging in a recess 14 on the circumference of the plate 6.

The precision of a power control or a controlled angular adjustment of the wobble plate 3 as a result of the gas pressures acting on the piston 2 and/or due to the dynamic forces acting on the wobble plate 3 in the case of a speed change is largely dependent on the magnitude of the frictional forces present on the wobble joints 9, 11. These frictional forces are particularly important for high pressure engines corresponding to the torque to be transmitted by the engine shaft 4, via the wobble joint 9, 11 to the wobble plate for the drive of the piston 2.

In order to reduce these frictional forces, according to the invention on the driving pin 9 are provided various friction-reducing engine components, such as roller bearings, sliding bushes and sliding disks. Embodiments thereof are shown in FIGS. 3 to 5.

FIGS. 2 to 5 show that the wobble joint is constructed as a knuckle joint. Its joint cheeks 12, 12' form driving extensions of the corotating wobble plate part 5 and has a significant spacing from one another in order to reduce the forces in the guide slots 11, 11' during the transmission of the torque from the engine shaft 4. In the represented embodiment this is twice as great as the diameter of the engine shaft 4.

In the embodiment according to FIG. 3 the driving pin is mounted in its central area 31 extending through a bore 30 of the driver 10 by means of two roller bearings 32, 33, which are placed in the bore 30 with a maximum mutual spacing. In addition, for the absorption of the force components acting in the longitudinal direction of the pin between the joint cheeks 12, 12' and the driver 10 on the one hand and the joint cheeks 12, 12' and the terminal fixing disks 38, 39 or a terminal shoulder 28 on the other, sliding disks 34 to 37 are provided, e.g. is accordance with standard AS-O515.

The embodiment of FIG. 4 differs from that of FIG. 3 by a sliding bush 41 engaging in one of the guide slots 11, 11' and carried by an end region 40 of the driving pin 9. Moreover, in place of four sliding disks, there is only a single sliding disk 42, which is located on the side of the force corresponding to the introduced torque between the driver 10 and the joint cheek 12'. It e.g. corresponds to standard AS-0715.

The sliding bush 41 makes a significant contribution to the reduction of the frictional forces, because between the guide slots 11, 11' and the pin end regions 40, 43 the frictional forces attempt to turn the driving pin 9 in opposite directions. This results from the directions of the reaction forces indicated by the arrows 44, 45 with respect to the outwardly displaced force indicated by the arrow 46 and corresponding to the introduction of the driving torque. This distribution of the forces acting on the wobble joint makes it clear that it can be sufficient to only have one sliding disk 42 on the side of the higher reaction force indicated by the arrow 45.

The embodiment of FIG. 5 differs from that of FIG. 4 in that for further reducing the frictional forces a roller bearing 47 is provided in place of a sliding bush 41.

The low frictional resistance resulting from the invention permit a precise control of the reciprocating engine, even when used for the particularly high gas pressure occurring in a $CO_2$ air conditioning system, so that a reciprocating engine according to the invention, despite the widely fluctuating rotation speeds of a vehicle drive is suitable for a $CO_2$ vehicle air conditioning system, without there being any need for a control by switching on and off a drive connection.

The control by modifying the angular adjustment of the wobble plate and therefore the compressing capacity can take place by modifying the gas pressure in the drive area 15 or on the underside of the piston 2, e.g. by means of a partial flow of the coolant circuit of a $CO_2$ air conditioning system branched off by means of a control valve. This partial flow also leads to an improvement of the lubrication, inter alia of the wobble joint by oil deposited from oil vapour. The oil for this oil vapour is e.g. obtained from the oil separator of a coolant circuit. The partial flow used for cooling purposes is supplied through bores 25, 26 firstly to the sealing device 27 and then to the drive area 15. It can also pass to the piston-side main bearing 29 through the hollow drilled engine shaft 4.

In order to keep constant the delivery quantity at changing rotation speeds, use can be make of the restoring torque of the wobble plate counteracting its inclined position due to dynamic forces on the corotating plate part 5. This can be assisted by the tensions of a spring means 20, so that the delivery quantity rising with increasing rotation speed can be compensated by resetting the inclined position of the wobble plate 3.

Through the arrangement of a helical spring 20 in an axial bore 21 of the engine shaft 4 shown in FIGS. 1 and 2, this can be achieved without enlarging the engine casing 22 or also with a size-reduced drive area 13 for high pressures and with a small wobble plate in such a way that a spring characteristic suitable for a constant control is obtained.

For the transfer of the spring movement from the helical spring 20 in the form of a compression spring to the wobble plate 3, it engages with pretension on a spring plunger 22 guided in the axial bore 21. The plunger transfers the spring movement by means of a coupling pin 23 through bilateral wall openings 24 of the engine shaft 4 to the wobble plate 3, in that the latter has on its corotating plate part 5 engagement openings not visible in the drawings. Said openings have an adequate positive allowance compared with the diameter of the coupling pin 23 to avoid a redundancy in determination of the fixing of the tilting movement defined by the wobble joint 9 and the tilting mounting on the engine shaft 4.

We claim:

1. Reciprocating engine with a wobble plate transmission, whose wobble plate (3) has a first wobble plate part (5) rotating with the engine shaft (4) and a second wobble plate part (6) in drive connecting with several pistons (2) and between which is located a rotary bearing (7, 8) transmitting the wobbling movement, the first wobble plate part (5) being connected to the engine shaft (4) by means of a wobble joint (9, 11) allowing different inclined positions, in that a driving pin (9) with engagement in a guide slot (11, 11') extends through driving extensions (10, 12, 12'), one being provided on the engine shaft (4) and the other on the wobble plate part (5) and between the driving pin (9) and at least one of the driving extensions (10, 12, 12') is provided at least one wear-reducing engine component (32–37, 41, 42, 47) carried by the driving pin (9), characterized in that the driving pin (9) extends through a driver (10), which engages between bearing cheeks (12, 12') forming driving extensions, the guide slots (11, 11') are provided on the bearing cheeks (12, 12'), which have a mutual spacing corresponding to one to two times the diameter of the engine shaft (4) and the at least one wear-reducing engine component is an engine component (32–37, 41, 42, 47) reducing friction by rolling contact.

2. Reciprocating engine according to claim 1, characterized in that the driving pin (9) is mounted in rotary manner by two bearings (32, 33) on its central area (31) extending through a bore (30) of the driver (10) and which are inserted with a maximum mutual spacing in said bore (30).

3. Reciprocating engine according to claim 1, characterized in that a sliding disk (35, 36, 42) is positioned between the central area (31) and at least one of the bearing cheeks (12, 12').

4. Reciprocating engine according to claim 1, characterized in that a sliding disk (34, 37) is positioned between at least one bearing cheek (12, 12') and an outer disk (38, 39) fixing the longitudinal positions of the driving pin (9) or a pin shoulder (28).

5. Reciprocating engine according to claim 1, characterized in that in addition to at least one bearing (32, 33) for the rotary mounting of the driving pin (9) a further rotary bearing (41, 47) is provided on an area (40) of the driving pin (9) engaging in one of the guide slots (11, 11'), so that the bearing ring of the rotary bearing (41, 47) rolls in the guide slot (11).

* * * * *